United States Patent [19]

Kojima et al.

[11] Patent Number: 4,785,150

[45] Date of Patent: Nov. 15, 1988

[54] PLATE-LIKE ALUMINA HEATER

[75] Inventors: Takao Kojima, Nagoya; Nobuhiro Hayakawa, Chita; Yutaka Nakayama; Tetsusyo Yamada, both of Nagoya, all of Japan

[73] Assignee: NGK Spark Plug So., Ltd., Aichi, Japan

[21] Appl. No.: 805,807

[22] Filed: Dec. 6, 1985

[30] Foreign Application Priority Data

Dec. 11, 1984 [JP] Japan ..... 59-260070

[51] Int. Cl.[4] ..... H05B 3/16

[52] U.S. Cl. ..... 219/543; 219/552; 338/308

[58] Field of Search ..... 219/538, 464, 544, 552, 219/553; 338/308, 309

[56] References Cited

U.S. PATENT DOCUMENTS 4,098,949 7/1978 Kosiorek ..... 338/308 X
4,203,025 5/1980 Nakatani et al. ..... 219/216

FOREIGN PATENT DOCUMENTS 73575 6/1980 Japan ..... 219/543
6513943 4/1967 Netherlands ..... 219/552

*Primary Examiner*—E. A. Goldberg
*Assistant Examiner*—C. M. Sigda
*Attorney, Agent, or Firm*—Wegner & Bretschneider

[57] ABSTRACT

A heater comprising a sheet substrate formed of alumina and an electron-conductive pattern provided thereon and designed to generate heat, in which at least a portion of the electron-conductive pattern is provided thereon with an oxygen ion-conductive layer.

8 Claims, 2 Drawing Sheets

PLATE-LIKE ALUMINA HEATER

FIELD OF THE INVENTION

The present invention relates to means for improving the durability of heaters in which an alumina substrate is provided thereon with an electron-conductive pattern for the purpose of generating heat.

BACKGROUND OF THE DISCLOSURE

In the prior art there has been produced a heater comprising an alumina substrate and an electron-conductive pattern provided thereon and designed to generate heat. However, when current is applied through the heater to generate heat, portions near to the cathode terminal (the heat-generating pattern and a portion of the substrate adjacent thereto) become black and increase in electric resistance. In an extreme case, the coating layer is peeled off. Due to the resulting reduction of the service life of the heater, there is a need of applying alternate current or increasing the electric resistance of the heater to limit the current flowing therethrough, thus offering a grave problem in view of use.

SUMMARY OF THE DISCLOSURE

An object of the present invention is to eliminate said problem in the prior art.

In the course of studies made on the method for preventing a lowering of the durability of such a heater using an alumina substrate due to blackening of portion near to the cathode, it has been found by the present inventors that the aforesaid object is achieved by providing an oxygen ion-conductive layer on the entire surface, or at least of a portion near to the cathode, of an electron-conductive pattern.

BRIEF DESCRIPTION OF THE DRAWINGS

In FIG. 1, the oxygen ion-conductive layer ($ZrO_2$ layer) 3 is applied only on a portion near cathode terminal pattern 6; in FIG. 2 or 3, it is applied over the entire surface of the heat-generating pattern 4, the cathode terminal pattern 6 and anode terminal pattern 6'; and in FIG. 4, it is applied on the cathode side alone. In FIG. 6, the oxygen ion-conductive layer ($ZrO_2$ layer ) 3 is applied on the blank space 3' in the latter step.

DETAILED DESCRIPTION OF THE PREFERRED EMBODIMENTS

Figure 1:
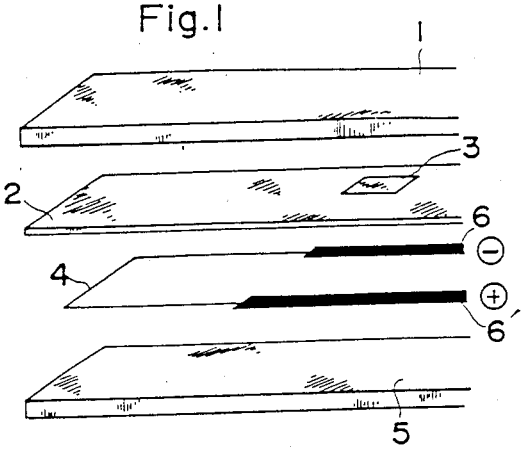
FIGS. 1 to 4 are views showing preferred embodiments of the heaters according to the present invention.

Although the reason why blackening of portions near to the cathode portion is avoided by the formation of an oxygen ion-conductive layer on the electron-conductive pattern is still unclarified, the blackening is considered to be primarily attributed to the reduction of $Al_2O_3$ or impurities therein in the vicinity of the cathode portion (and probably to the catalytic action of Pt diffused into the conductive pattern). In other words, the blackening appears to be caused due to the fact that electrons produced by the application of a voltage flow not only in the electron-conductive portion provided on the substrate but also in the substrate, consume a minute amount of oxygen in the electron-conductive portion ($O_2+4e \rightarrow 2O^{2-}$) and further reduce $Al_2O_3$ (or impurities in $Al_2O_3$) (for instance, expressed in terms of $Al_2O_3+2xe \rightarrow Al_2O_{3-x}+XO^{2-}$), with the resulting $O^{2-}$ reacting with Pt to yield PtO which is in turn sublimated. Such reduction is presumed to be inhibited by the provision of the oxygen ion-conductive layer.

The oxygen ion-conductive layer used in the present invention is formed of sintered bodies of oxides of Zr, Th or Hf, or a mixture thereof. Particularly preferred sintered bodies contain 90% by weight or more of partially and/or entirely stabilized $ZrO_2$. The wording "partially and/or entirely stabilized $ZrO_2$" is herein understood to refer to sintered products of $ZrO_2$ to which stabilizers such as $Y_2O_3$, CaO, MgO, etc. have been added. The oxygen ion-conductive layer may be applied on the entire surface, or a portion near to the cathode portion, of the electron-conductive pattern. The oxygen ion-conductive layer has also a thickness of, preferably 10 to 150 microns, most preferably 20 to 80 microns.

A sheet-like sintered body of $Al_2O_3$ having a purity of no lower than 90% is used as the substrate of the heater according to the present invention. The electron-conductive pattern may be obtained by forming a paste composed mainly of Pt, Rh, W, Mo or a mixture thereof (which may include some amounts of oxides) on the substrate or the oxygen ion-conductive layer by the known techniques such as screen printing, etc., followed by heating.

In most cases, the heaters of the present invention are usually of the structure wherein the electron-conductive pattern and the oxygen ion-conductive layer 3 are sandwiched between the alumina protective layer 1 and the alumina substrate 5 (FIGS. 1 to 4). An alumina protective layer 1 may be provided for the purpose of improving durability and preventing warpage, but may be dispensed with in some cases.

It is noted that, in the productioon of the heaters of the present invention, the structural parts may independently be sintered for assembling, but it is preferred that, after lamination, the respective layers are simultaneously sintered to improve the integrality therebetween.

In accordance with the present invention, it is possible to apply the oxygen ion-conductive layer on the electron-conductive pattern, thereby preventing deterioration (blackening) of the cathode portion of said pattern and further improving the durability of the heater against current. Also, the present invention serves to prevent the aforesaid blackening by means of an extremely simple layer structure.

In the following, the present invention will be explained with reference to the examples.

EXAMPLES (1) An organic binder was added to the starting material comprising 92 wt % $Al_2O_3$ (having a purity of no lower than 90% and a particle size of no higher than 2.5 microns) and 3 wt % $SiO_2$ to prepare a sheet-like sample of 42 mm in green length, 4.8 mm in green width and 0.8 mm in green thickness by the doctor blade process.

(2) Pt black and Pt sponge were formulated together in a proportion of 2:1 to prepare an ink paste with butyl carbidol.

Figure 5:
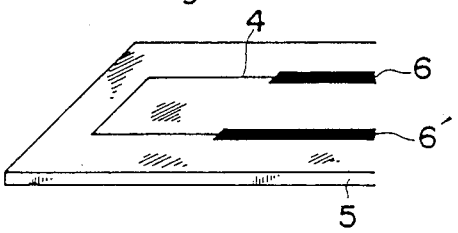
FIGS. 5 and 6 are views illustrating the procedures for producing the heaters mentioned in Examples.

(3) The paste (2) was screen-printed on the sheet obtained at the step (1) into a thickness of about 15 microns to form a heat-generating pattern 4 cathode terminal pattern 6 and anode terminal pattern 6', as illustrated in FIG. 5.

Figure 6:
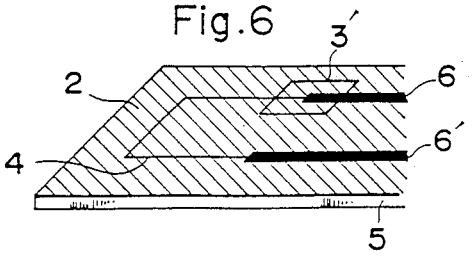

(4) Subsequently, a mixture of 92 wt % $Al_2O_3$+3 wt % $SiO_2$, as used in (1), was formulated into an ink paste with butyl carbidol, which was then screen-printed on a portion 2 except for a blank space 3' covering part of the cathode terminal and part near thereto into a thickness of about 15 microns, as shown in FIG. 6.

(5) Subsequently, a paste comprising 94 mol % $ZrO_2$ (with a mean particle size being 0.8 microns) and 6 mol % $Y_2O_3$ (with a mean particle size being 0.3 microns) was screen-printed on the blank space 3', as shown in FIG. 6, into a thickness of about 15 microns.

(6) The paste of (4) was screen-printed over the entire surface of the resulting product into a thickness of 15 microns.

(7) After resins had been removed at 250° C. for 12 hours, sintering was carried out at 1520° C. for 4 hours in the air.

(8) For the purpose of comparison, the step (6) was repeated twice immediately after the step (3). Thereafter, sintering was carried out at 1520° C. for 4 hours.

Figure 2:
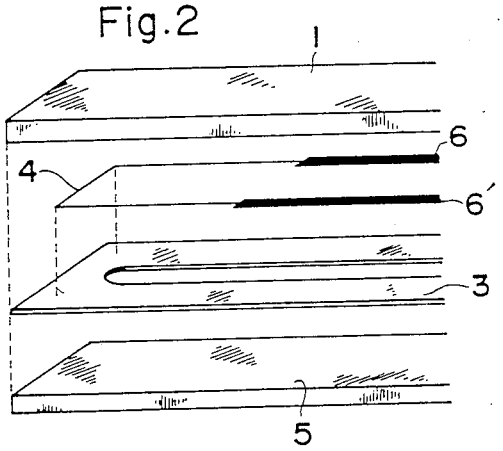
Figure 3:
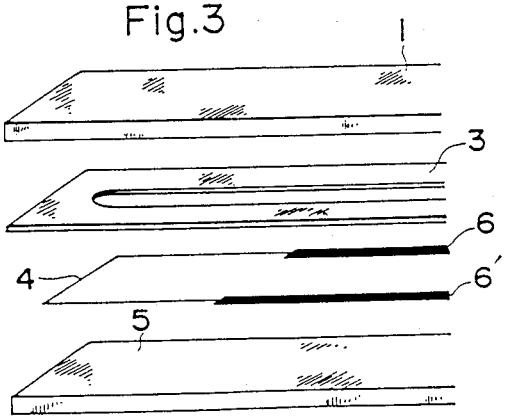
Figure 4:
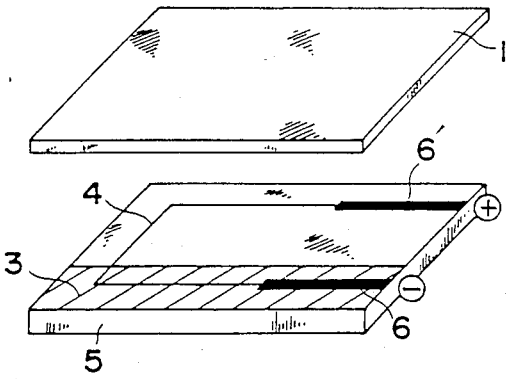

(9) The heaters of the structures, as shown in FIGS. 2, 3 and 4, were prepared with the same starting materials as mentioned above.

(10) With the heaters prepared in this manner, durability testing was effected at a voltage of 16 V, and the results as set forth in Table 1 were obtained.

TABLE 1

(Resistance Values: measured at room temperature)

| | Structure | Initial Resistance | Results of Durability Testing | | | |
|---|---|---|---|---|---|---|
| Example 1 | FIG. 1 | 3.4Ω | 200 hours | only the boundaries became somewhat black | 500 hours | only the boundaries became somewhat black |
| Example 2 | FIG. 2 | 3.4Ω | 200 hours | no change | 500 hours | no change |
| Example 3 | FIG. 3 | 3.5Ω | 200 hours | no change | 500 hours | no change |
| Example 4 | FIG. 4*1 | 3.6Ω | 200 hours | no change | 500 hours | no change |
| comparison Example | no provision of $ZrO_2$ layer | 3.5Ω | 120 hours | Blackening and peeling-off of coat | 200 hours | disconnection |

*1 $ZrO_2$ was coated on the $Al_2O_3$ substrate(5) side alone.

From the results of Table 1, it is found that the heaters of the present invention excel extremely in durability.

It is to be understood that, in the example of FIG. 4, the oxygen ionconductive layer ($ZrO_2$ layer) 3 of FIGS. 2 or 3 may be provided on the cathode side alone. The layer 3 may be applied between the heat-generating pattern 4 and the alumina substrate 5 or between the alumina protective layer 1 and the pattern 4.

It should be understood modifications may be done without departing from the gist and scope of the present invention disclosed herein and claimed as hereinbelow accompanying.

What is claimed is:

1. A heater comprising a sheet substrate formed of alumina having an electron-conductive pattern formed on a surface of the substrate and designed to generate heat, wherein at least a portion of said electron-conductive pattern is provided with an oxygen ion conductive layer on at least one side of said electron-conductive pattern, wherein at least 90% by weight of the oxygen ion-conductive layer consists of partially and/or entirely stabilized $ZrO_2$.

2. A heater as defined in claim 1, in which said alumina substrate has an alumina purity of at least 90% by weight.

3. A heater as defined in claim 1, in which said oxygen ion-conductive layer is 10–150 microns thick.

4. A heater as defined in claim 1, in which said oxygen ion-conductive layer is disposed on a cathode side portion of the electron-conductive pattern.

5. A heater as defined in claim 1, in which said oxygen ion-conductive layer is disposed on a cathode terminal portion of the electron-conductive pattern.

6. A heater as defined in claim 1, in which said oxygen ion-conductive layer is disposed on said electron-conductive pattern so as to cover said electron-conductive pattern.

7. A heater as defined in claim 1, in which said oxygen ion-conductive layer underlies said electron-conductive pattern.

8. A heater as defined in claim 1, in which said oxygen ion-conductive layer extends over the surface of the substrate outside said electron-conductive pattern.

* * * * *